US005216723A

United States Patent [19]

Froeschle et al.

[11] Patent Number: 5,216,723

[45] Date of Patent: Jun. 1, 1993

[54] PERMANENT MAGNET TRANSDUCING

[75] Inventors: Thomas A. Froeschle, Southborough; Ricardo F. Carreras, Framingham, both of Mass.

[73] Assignee: Bose Corporation, Framingham, Mass.

[21] Appl. No.: 667,461

[22] Filed: Mar. 11, 1991

[51] Int. Cl.[5] ..... H04R 11/00

[52] U.S. Cl. ..... 381/201; 381/199; 381/200; 381/205

[58] Field of Search ..... 381/200, 96, 199, 201, 381/192, 193, 194, 195, 197, 199, 202, 205

[56] References Cited

U.S. PATENT DOCUMENTS

| | | | |
|---|---|---|---|
| 2,026,994 | 5/1929 | Messick | 381/201 |
| 3,062,926 | 3/1959 | Ronci | 381/200 |
| 3,937,904 | 2/1976 | Parker | 381/201 |
| 4,020,361 | 4/1977 | Suelzle et al. | 307/106 |
| 5,009,281 | 4/1991 | Yokoyama | 381/96 |

*Primary Examiner*—Jin F. Ng
*Assistant Examiner*—Edward Lefkowitz
*Attorney, Agent, or Firm*—Fish & Richardson

[57] ABSTRACT

A transducer includes a core of low reluctance magnetic material formed with a narrow gap. There are first and second coils of conductive material wound on the core adjacent to and on opposite sides of the gap. A permanent magnet in and substantially filling the gap is in noncontacting relationship with the core and supported to allow relative movement between the permanent magnet and the core. The core may be generally U-shaped, C-shaped or 8-shaped with the path of relative movement between the permanent magnet and the core usually generally perpendicular to the plane of the core. No portion of the core is in the plane of permanent magnet movement. The permanent magnet preferably comprises first and second contiguous permanent magnet elements having adjacent unlike poles along a boundary substantially midway between opposed surfaces of the core along the direction of relative motion.

56 Claims, 12 Drawing Sheets

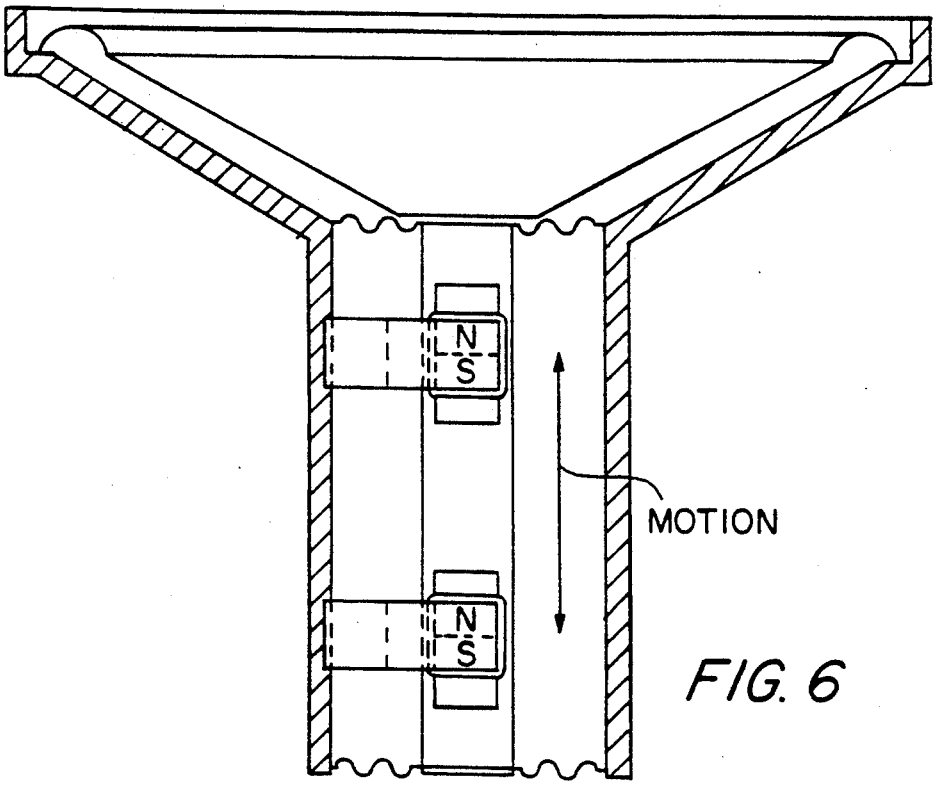
FIG. 6
FIG. 5
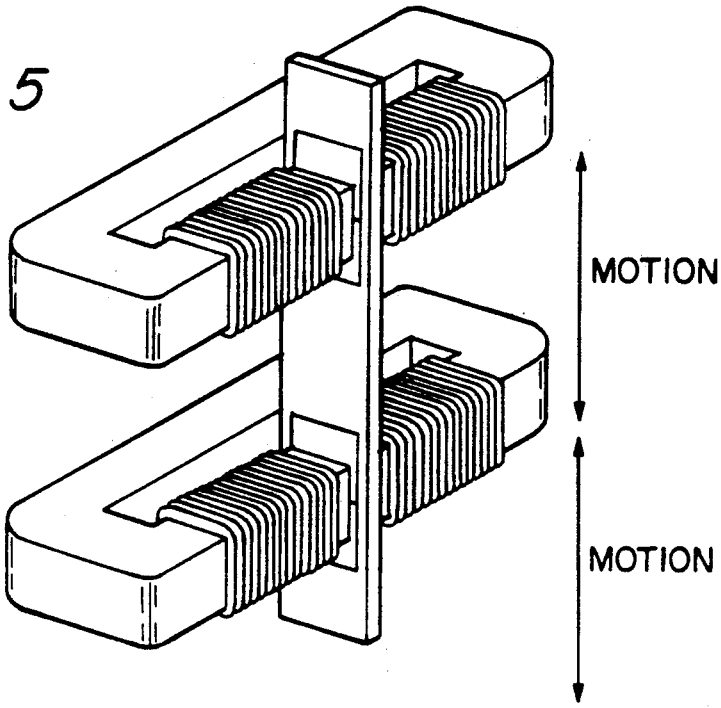

PERMANENT MAGNET TRANSDUCING

The present invention relates in general to permanent magnet transducing and more particularly concerns novel apparatus and techniques for exchanging mechanical and electrical energy using a permanent magnet and relatively movable coil on a low reluctance magnetic core.

Typical prior art moving magnet electromechanical transducers are disclosed in U.S. Pat. Nos. 3,798,391, 3,917,914 and 3,937,904. The latter patent discloses a transducer having a U-shaped core of magnetically permeable material with attached pole pieces defining a gap and a stationary electrical coil on the bight of the U-shaped core far from the gap. A permanent magnet is positioned for movement through the central portion of the gap in the plane of the U-shaped core toward and away from the coil on the bight. The permanent magnet has diagonally positioned poles of like magnetic orientation to provide a north-south pole combination facing one of the pole pieces and a complementary south-north pole combination facing the other pole piece.

It is an important object of this invention to provide improved permanent magnet transducing.

According to the invention, there is a core of low reluctance magnetic material formed with a narrow gap. There are first and second coils of conductive material wound on the core adjacent to and on opposite sides of the gap. A permanent magnet in and substantially filling the gap is in noncontacting relationship with the core and supported to allow relative movement between the permanent magnet and the core. The core may be generally U-shaped, C-shaped or 8-shaped with the path of relative movement between the permanent magnet and the core usually generally perpendicular to the plane of the core. No portion of the core is in the plane of permanent magnet movement. The permanent magnet preferably comprises first and second contiguous permanent magnet elements having adjacent unlike poles along a boundary substantially midway between opposed surfaces of the core along the direction of relative motion.

According to an aspect of the invention, there is a diaphragm connected to the permanent magnet whereby an electrical signal may be applied to the first and second windings to produce a corresponding magnetic field in the gap causing corresponding relative displacement between the permanent magnet and the core and corresponding relative displacement of the diaphragm. There may be a frame having first and second ends with the periphery of the diaphragm supported in the frame at a first suspension element at the second end and inside the frame and a second suspension element supported inside the frame between the diaphragm and the first suspension element, with the permanent magnet being connected between the first and second suspension elements inside the frame.

Preferably there is a combiner having a signal input, a feedback input and an output for providing a combined signal related to the combination of signals on said signal input and said feedback input. There is a controlled signal source having an input coupled to the combiner output and an output coupled to at least one of the windings providing a controlled signal. There is a feedback circuit intercoupling the transducer and the feedback input, preferably providing a feedback signal related to at least one of velocity and acceleration of the permanent magnet assembly, or voltage and current in the windings.

Numerous other features and advantages will become apparent from the following detailed description when read in connection with the accompanying drawings in which:

FIG. 5 is a perspective view of another embodiment of the invention comprising two parallel C-core transducers with the cores in parallel spaced alignment;

FIG. 6 is an axial sectional view of a loudspeaker driver including the transducer of FIG. 5;

Figure 1:
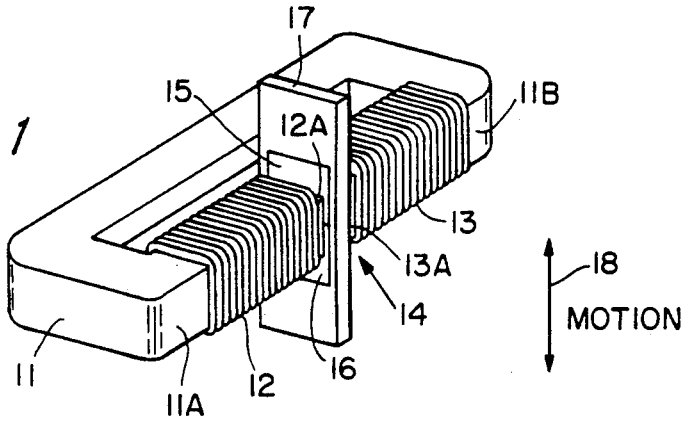
FIG. 1 is a perspective view of an exemplary embodiment of the invention.

With reference now to the drawings and more particularly FIG. 1 thereof, there is shown a perspective view of a transducer according to the invention. A C-shaped core 11 of material of low magnetic reluctance, such as soft iron, carries a first winding 12 and second winding 13 of conducting material wound on legs 11A and 11B closely adjacent to gap 14 substantially filled by permanent magnets 15 and 16 seated in movable magnet support 17. Windings 12 and 13 are substantially contiguous with gap 14. Gap 14 separates opposed pole faces 12A and 13A. Permanent magnets 15 and 16 have adjacent unlike poles, the boundary between the poles being located midway, along the direction of relative motion 18, between opposed surfaces of core 11, when the current through windings 12 and 13 is substantially zero and with no other external force applied.

Figure 2:
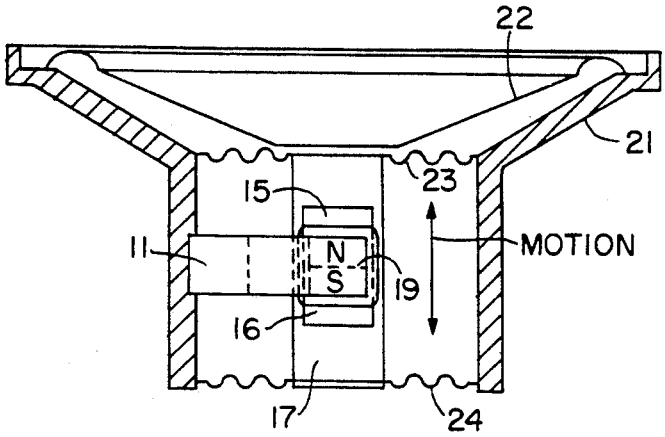
FIG. 2 is an axial sectional view of a loudspeaker driver according to the invention.

Referring to FIG. 2, there is shown an axial sectional view of a loudspeaker driver incorporating the transducer of FIG. 1. The same reference symbols identify corresponding elements throughout the drawing.

Loudspeaker basket 21, which may be metal, plastic or other suitable material, anchors the edge of loudspeaker cone or diaphragm 22, to spider suspension elements 23 and 24 at opposite ends of the basket portion that encloses the transducer of FIG. 1 with core 11 seated in a wall of basket 21 as shown. One end of permanent magnet support 17 is connected to spider suspension element 24 and the other end to spider suspension element 23 and cone or diaphragm 22. The rectangular magnet assembly comprises permanent magnet support 17 and rectangular magnets 15 and 16 having reversed polarity of magnetization suspended in the center of gap 14 of C-shaped core 11. Coils 12 and 13 are connected in series and polarized so that the magnetic fields produced by current flowing through them adds constructively. With this arrangement, current in coils 12 and 13 produces a magnetic field which attracts one of the two rectangular magnet polarity regions and repels the region of opposite polarity to produce a force along the direction indicated by arrow 18 transverse to the plane of C-shaped core 11. The resulting force is linearly related to the current applied to coils 12 and 13 and is nearly independent of the position of the magnet assembly in the direction of motion until the boundary 19 between regions of magnet polarity reaches the edge of C-shaped core 11. The combined mass of the loudspeaker diaphragm and the suspension elements is preferably less than twice the means of the permanent magnet assembly with the transducer having coil inductance with at least one-third of the coil inductance attributable to magnetic energy stored in the gap. The mass of the permanent magnet assembly is preferably at least 10 grams, and the area of the diaphragm greater than or equal to 0.015 $m^2$.

Figure 3:
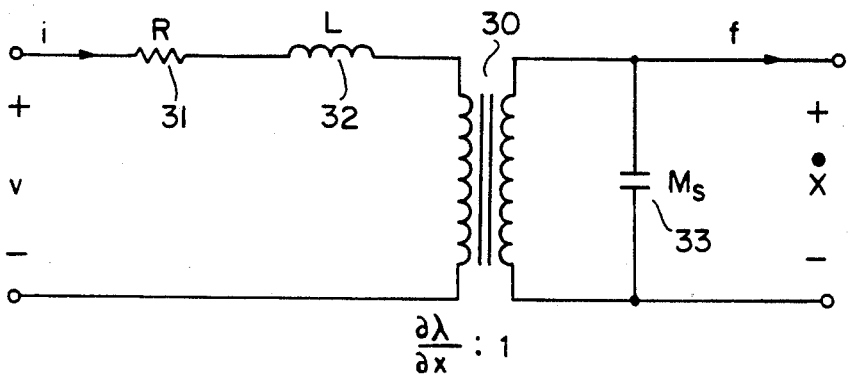
FIG. 3 is an equivalent electrical circuit of the transducer according to the invention.

Referring to FIG. 3, there is shown an idealized electrical circuit equivalent model of the transducer of FIGS. 1 and 2. This model comprises transformer 30, resistance 31, inductance 32 and capacitance 33. Inductance 32 and capacitance 33 may be regarded as elements which limit the bandwidth of the transducer.

It can be shown that the maximum bandwidth for the transducer of FIG. 1 is:

$$\omega_B = \frac{B_m}{h}\sqrt{\frac{2}{d_m\mu_m}} \tag{1}$$

where $\omega_B$ is the maximum bandwidth, $B_m$ is the remanence or residual induction produced by permanent magnets 15 and 16, h is the peak-to-peak excursion of the permanent magnet assembly; $d_m$ is the density of the permanent magnets 15 and 16 and $\mu_m$ is the magnetic permeability of magnets 15 and 16. To achieve this maximum bandwidth, clearances between the moving permanent magnet assembly comprising magnets 15 and 16 and support 17 and C-shaped core 11 are infinitesimal, there is no magnetic leakage and the mass of the permanent magnet assembly is solely composed of the two rectangular magnet regions 18 and 16 of opposite polarity; that is, the mass of the support spider and cone is negligible compared to that of the magnet.

The minimum mass of the moving magnets 15 and 16 is defined by the mechanical work produced by (or applied to) the transducer. The expression for mass is:

$$M_m = \frac{f_{max}hd_m}{B_mH_m} \tag{2}$$

where $f_{max}$ is the maximum force produced by the permanent magnet assembly 17, and $H_m$ is the maximum magnet field in the volume of permanent magnets 15 and 16, $M_m$ being the mass of the moving magnets 16 and 15.

Figure 4:
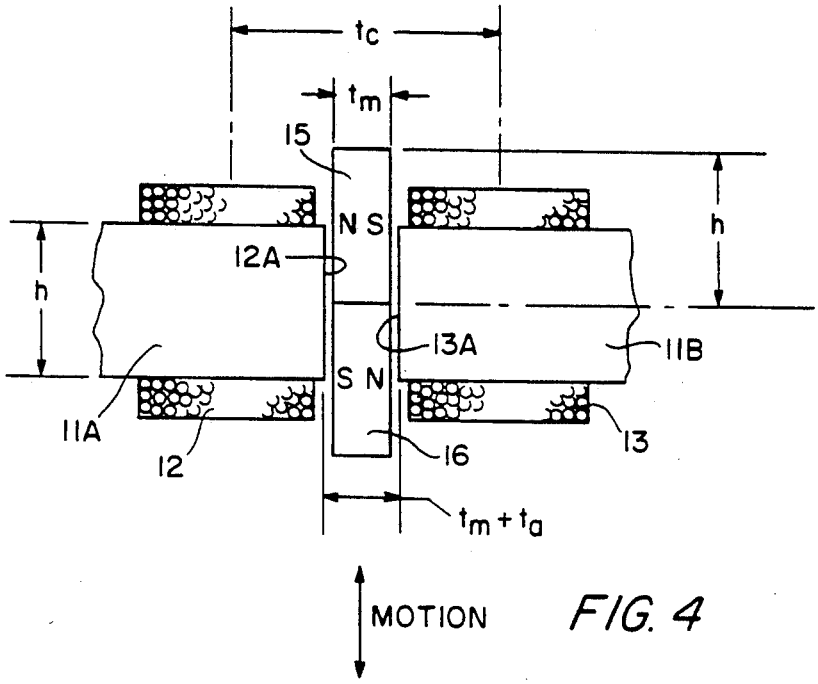
FIG. 4 is a fragmentary sectional view of the gap region of the transducer of FIG. 1.

Referring to FIG. 4, there is shown a fragmentary view of gap 14 in core 11. The magnet thickness is defined as $t_m$. The total width of gap 14 in C-shaped core 11 is $t_m+t_a$ where $t_a$ is the width of the space between C-shaped core 11 and magnets 15 and 16. The spacing between the centers of coils 12 and 13 is $t_c$. The inductive energy stored in inductor 32 is dependent on magnet volume and, therefore, on the mechanical work. Maximum inductive energy storage in inductor 32 occurs at maximum force:

$$E_L(\max) = \frac{\mu_m H_m^2 V_m}{4}\left(\frac{t_a}{t_m}\,\frac{\mu_m}{\mu_0} + 1\right) \tag{3}$$

where $V_m$ is the volume of magnets 15 and 16 and $\mu_o$ is the magnetic permeability of air.

To maximize the bandwidth of the transducer, this inductive stored energy should be held to a minimum. This result may be accomplished by minimizing the air gap width $t_a$. The air gap width may be minimized by using precise suspension elements, such as 23 and 24, to maintain the permanent magnet assembly centered under all operating and environmental conditions. In applications such as a loudspeaker driver, the suspension system must not exhibit static friction because such friction is nonlinear, producing audible distortion. By locating suspension elements 23 and 24 at each end of the magnet assembly, the centering is accurate and best able to resist forces normal to the direction of motion between the permanent magnet assembly and the poles of C-shaped core 11. These transverse forces are termed "crashing forces." Crashing forces are zero if the transducer is assembled with the magnet assembly perfectly centered in gap 14 of C-shaped core 11. However, in practical assemblies with imperfect centering, crashing forces exist. Furthermore, the crashing forces increase in proportion to the extent of deviation from perfect centering. In effect, magnetic forces produce a negative spring characteristic which produces a force directed toward the nearer pole face adjacent gap 14. In experimental structures, this negative spring force has been measured to be 250,000 N/m. Since the offset from perfect centering may only be 0.0001 m, the absolute force is small, typically about 25 N. It is preferred that the suspension be capable of maintaining centering within 0.05 mm with a sustained load of 12.5 N for the duration of the life of the transducer.

It has also been discovered that the spacing $t_c$ between coil centers is important for minimizing inductance. In experimental transducers, it has been discovered that the inductance can be increased by more than a factor of 2 if the coil spacing is not minimized. Thus, coils 12 and 13 are positioned as close to gap 14 as practical and may comprise multiple layer windings to further minimize $t_c$ and the resultant inductance for a given number of turns while maintaining a desired resistance.

Another feature of the invention for loudspeaker driver applications is that the structure may be used for combining stereophonic quad or other multiple-channel input signals to function as an analog and produce a monophonic excitation desirable in a system using the transducer as a subwoofer by applying, for example, the left channel signal to coil 12 and the right channel signal to coil 13. The resulting force produced by the transducer is then proportional to the sum of the left channel and right channel signals.

Referring to FIG. 5, there is shown a perspective view of another embodiment of the invention using two of the transducers of FIG. 1 in tandem to produce increased force. FIG. 6 shows an axial sectional view of a loudspeaker driver incorporating the transducer of FIG. 5.

Figure 8:
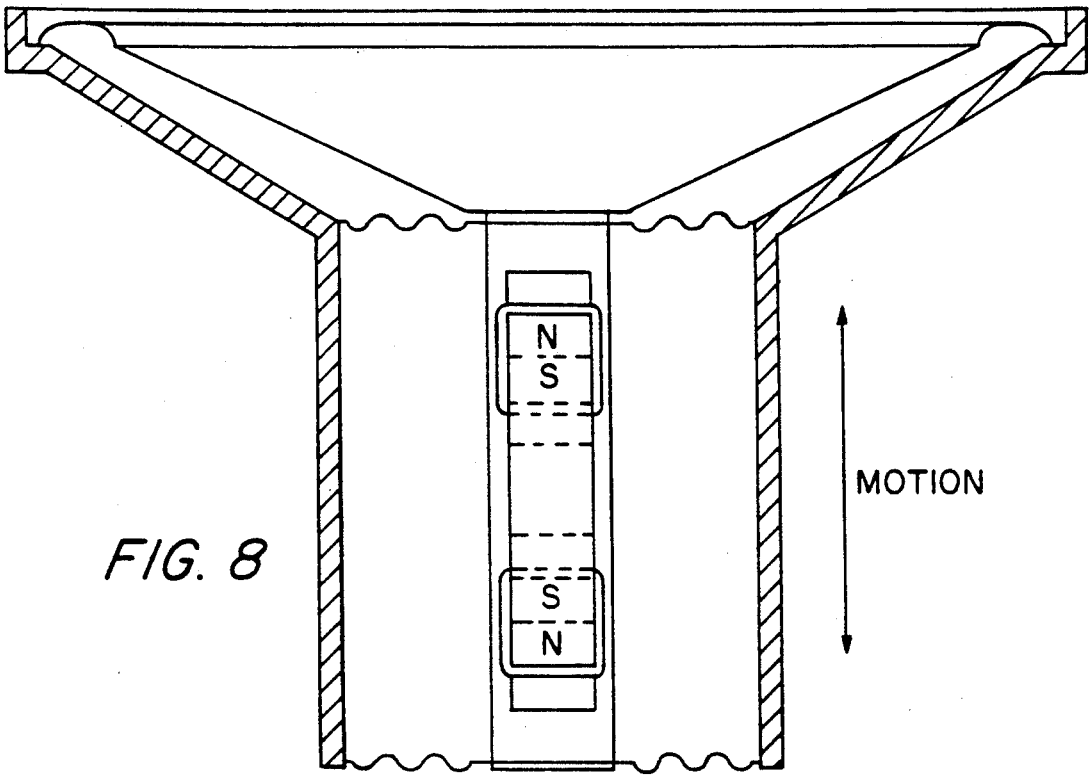
FIG. 8 is a sectional view of a loudspeaker driver incorporating the transducer of FIG. 7.
Figure 7:
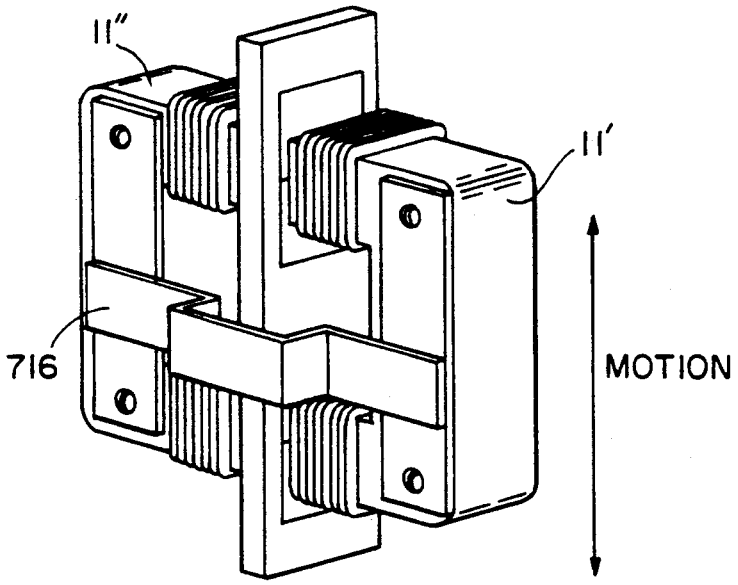
FIG. 7 is a perspective view of another embodiment of the invention comprising a pair of U-shaped cores strapped together to define a pair of spaced gaps formed between leg ends.

Referring to FIG. 7, there is shown a perspective view of another embodiment of the invention using U-shaped cores 11' and 11'' joined together by rigid members, such as 716, on both sides. FIG. 8 is an axial sectional view of a loudspeaker driver incorporating the transducer of FIG. 7.

Figure 10:
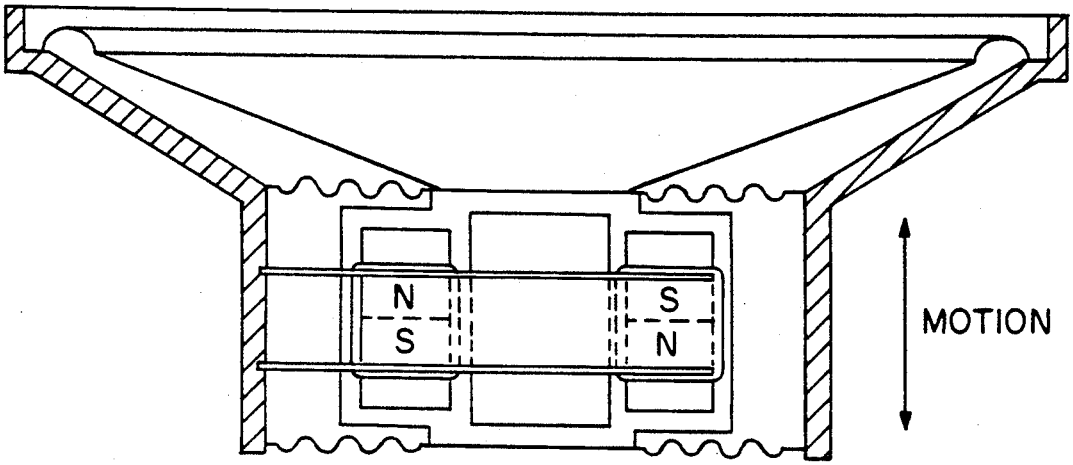
FIG. 10 is an axial sectional view of a loudspeaker driver incorporating the transducer of FIG. 9.
Figure 9:
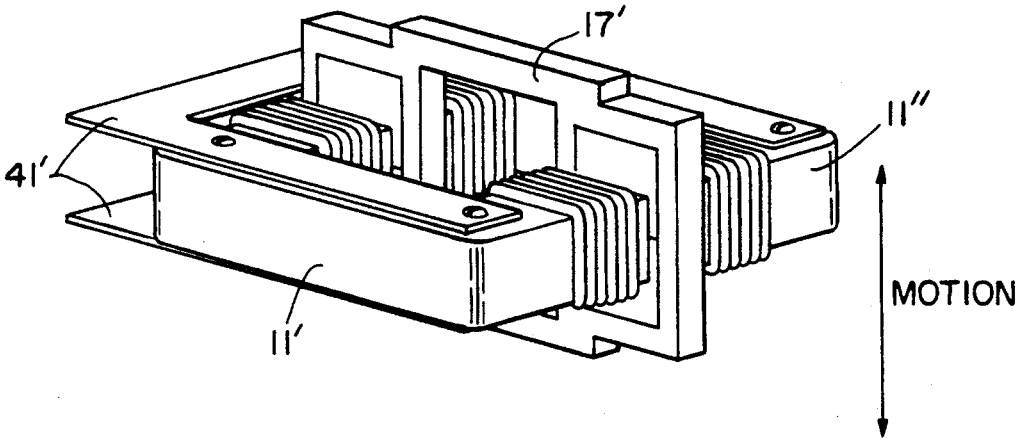
FIG. 9 is a perspective view of another embodiment of the invention comprising a pair of U-shaped cores strapped together defining spaced gaps with a pair of spaced parallel permanent magnet members in respective gaps in fixed relationship.

Referring to FIG. 9, there is shown a perspective view of another embodiment of the invention using U-shaped cores 11' and 11'' and held together by rigid members 41' with the permanent magnet assemblies in spaced parallel relationship carried by support 17'. FIG. 10 is an axial sectional view of a loudspeaker driver incorporating the transducer of FIG. 9.

Figure 12:
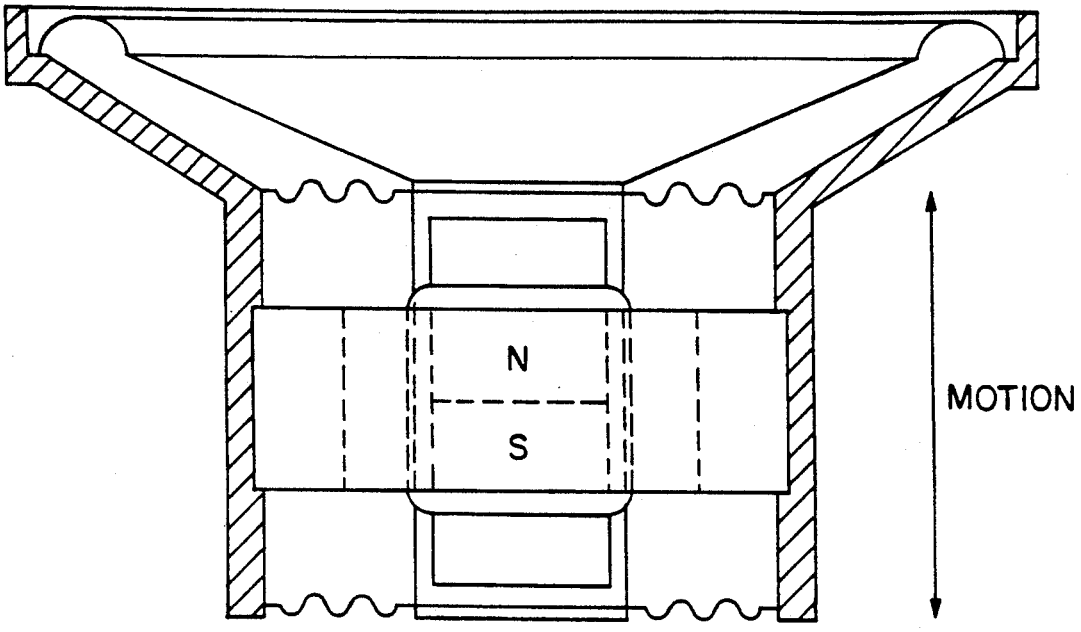
FIG. 12 is an axial sectional view of a loudspeaker driver using the transducer of FIG. 11.
Figure 11:
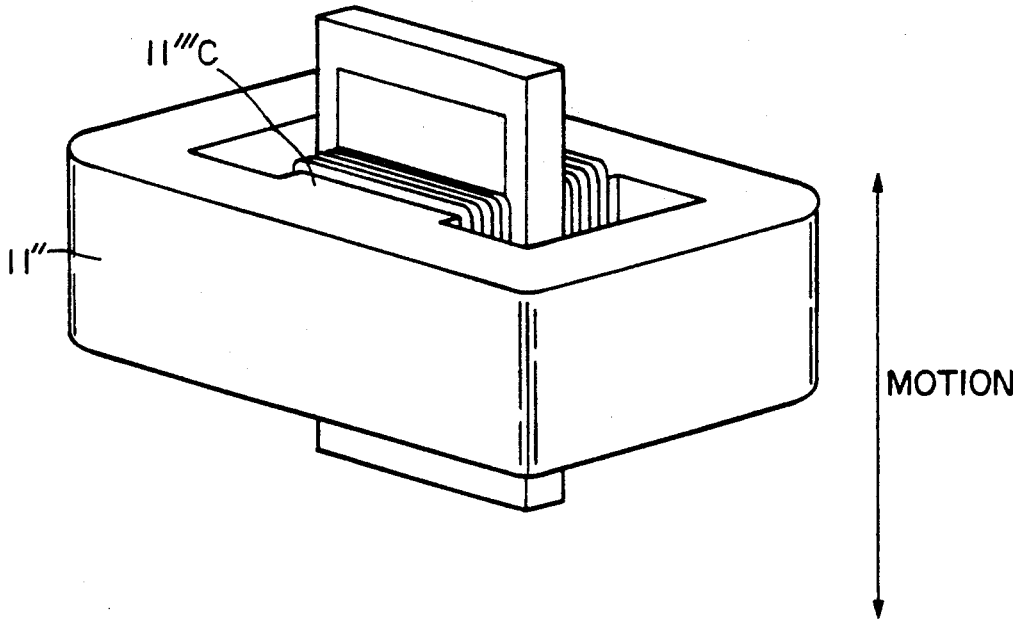
FIG. 11 is a perspective view of another embodiment of the invention using a figure-of-eight core with a gap in the central bar.

Referring to FIG. 11, there is shown a perspective view of an embodiment of the invention using a figure-of-eight core 11'' with the gap in the central cross member 11'''C. FIG. 12 is an axial sectional view of a loudspeaker driver incorporating the transducer of FIG. 11.

Other features of the invention reside in novel applications of active feedback and switching amplifiers. It is desirable to have a loudspeaker motor as efficient as possible to reduce thermal energy loss. Achieving this feature typically interferes with obtaining a flat frequency response over the desired bandwidth for the driver. Over a wide frequency band the enclosure housing the driver presents a varying mechanical load to the loudspeaker motor. It is desired to drive this varying mechanical load with the loudspeaker motor while maintaining the resulting frequency response relatively smooth.

The typical prior art approach chooses loudspeaker motor parameters for smooth acoustic response over the desired bandwidth. These parameters typically result in loudspeaker motors that experience high thermal stress which impose limitations on the acoustic performance of the loudspeaker enclosure system. It has been discovered that with active feedback a desired acoustic response (system alignment) can be achieved without compromising the loudspeaker motor parameters.

Figure 13:
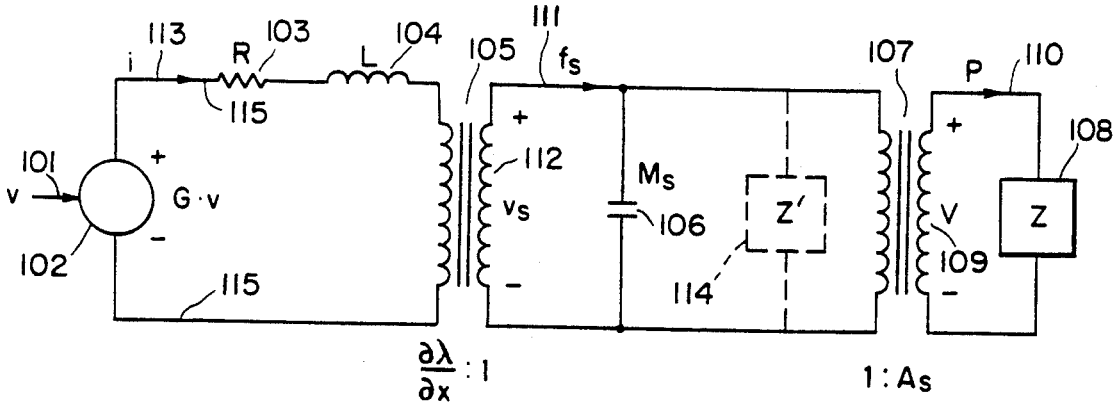
FIG. 13 PRIOR ART
FIG. 13 is the equivalent circuit of a prior art device.

Referring to FIG. 13, there is shown an idealized electrical model of a prior art speaker and its drive. An electrical audio signal on input 101 to be reproduced energizes amplifier 102 to provide an amplified audio signal that is applied to the input terminals 115 of the transducer. Current flows through line 113 and the electrical resistance 103 and inductance 104 of the loudspeaker motor and is coupled to the mechanical motion of the cone through transformer 105 having a secondary 112. The moving mass of the loudspeaker motor is modeled as capacitor 106 and the coupling from the cone to the enclosure 108 is performed through cone area transformer 107 having a secondary 109 furnishing pressure on line 11. It is convenient to combine the load modeling acoustic enclosure 108 with cone area transformer 107 to form an equivalent impedance Z' 114. where Z is the impedance presented by acoustic enclosure 108 and $A_s$ is the effective cone or diaphragm area. For a given acoustic enclosure and cone area characterized by an equivalent impedance Z' 114, the parameters $\partial\lambda/\partial x$, $M_s$, L and R are chosen so that a desired frequency response occurs over the selected frequency band. The function that relates input voltage v to output volume velocity V is:

$$v_s\left[\left(1+\frac{L}{R}s\right)\left(M_s s+\frac{1}{Z'}\right)+\frac{\left(\frac{\partial\lambda}{\partial x}\right)^2}{R}\right]=vG\frac{\left(\frac{\partial\lambda}{\partial x}\right)}{R} \tag{5}$$

where L is the electrical inductance, R is the electrical resistance, $M_s$ is the total moving mass of the loudspeaker, s is $j\omega$ where $\omega$ is $2\pi$ times the frequency, $\partial\lambda/\partial x$ is the force coefficient and G is the gain. This equation completely describes the effects of the motor parameters on the response of the system because the acoustic load Z' 114 is independent of the loudspeaker motor.

The efficiency $\beta$ of the loudspeaker motor is expressed as the ratio of mechanical force production to the thermal loss incurred while producing that force.

$$\beta=\frac{\left(\frac{\partial\lambda}{\partial x}i\right)^2}{i^2R}=\frac{\left(\frac{\partial\lambda}{\partial x}\right)^2}{R} \tag{6}$$

where i is the current through inductor 104, $\partial\lambda/\partial x$ is the force coupling coefficient 105 and R is the electrical resistance 103. For thermal considerations it is desirable to make $\beta$ as large as possible; however, if equation (5) is modified to substitute $\beta$ for the ratio in equation (6):

$$v_s\left[\left(1+\frac{L}{R}s\right)\left(M_s s+\frac{1}{Z'}\right)+\beta\right]=vG\frac{\left(\frac{\partial\lambda}{\partial x}\right)}{R}, \tag{7}$$

the resultant equation shows that the efficiency $\beta$ of the loudspeaker motor affects the loudspeaker acoustic response.

The prior art approach for achieving a relatively smooth frequency response over a specified bandwidth is to select a value for $\beta$ below optimum efficiency.

Figure 14:
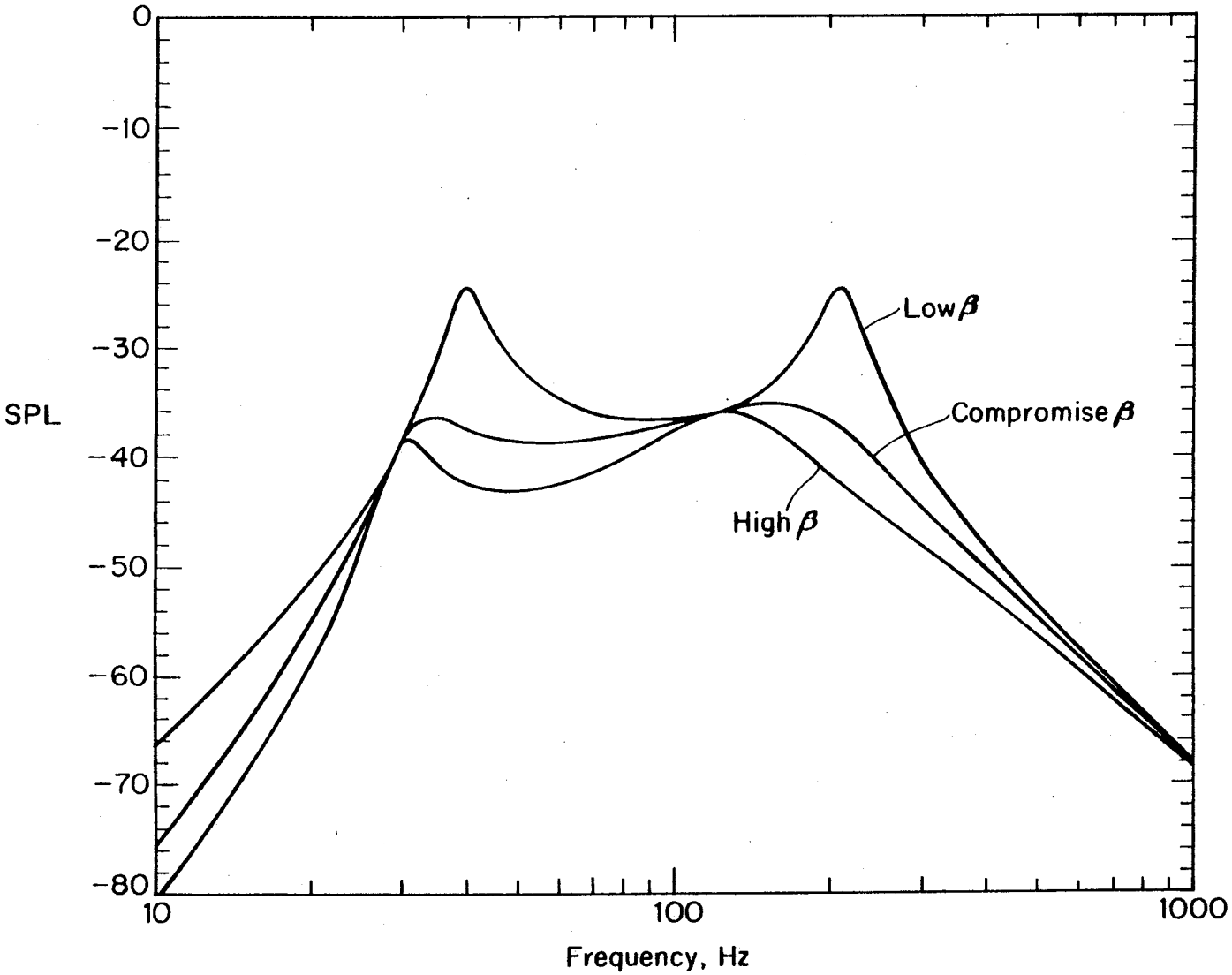
FIG. 14 PRIOR ART
FIG. 14 is a graphical representation of typical frequency responses for loudspeaker drivers according to the invention.

Referring to FIG. 14, there is shown a graphical representation of typical frequency responses for the equivalent circuit model of FIG. 13 for three different values of $\beta$. For low values of $\beta$ the response has sharp peaks which result in a less than ideal response. As the loudspeaker motor parameter $\beta$ is increased, the smoothness of response increases; however, if $\beta$ is increased further to values of higher efficiency, the response smoothness decreases. The intermediate compromise value of $\beta$ results in low efficiency for converting input energy into acoustic energy and increased heating of the loudspeaker motor.

A linear power amplifier could be used with a high $\beta$ motor. In such a case equalization could be used to improve the frequency response. Some power dissipation is moved from the loudspeaker to the amplifier and the equalized frequency response is sensitive to changes in loudspeaker parameters.

According to a feature of the invention, driving the motor with a switched mode power amplifier, such as disclosed in U.S. Pat. Nos. 3,294,981 and 4,456,872, incorporated herein by reference, and using active feedback allows the use of high $\beta$ motors while maintaining the desired system acoustic performance.

Figure 15:
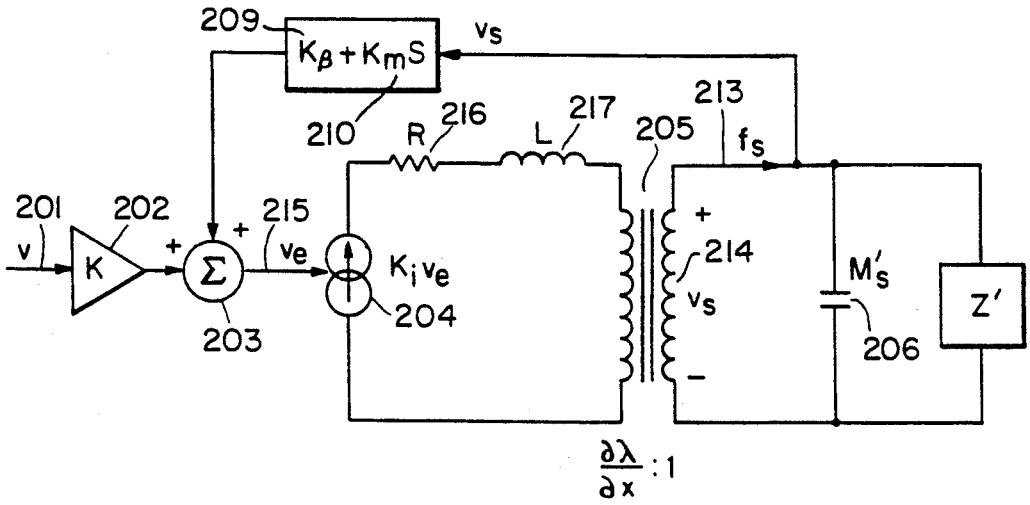
FIG. 15 is a combined block-schematic circuit diagram of a system according to the invention incorporating the transducer according to the invention.

Referring to FIG. 15, there is shown an electrical circuit model of an active acoustic system according to this invention. An input signal on input 201 energizes amplifier 202 that energizes one input of combiner 203. The output of combiner 203 on line 215 energizes controlled signal source 204, which is preferably a controlled current source, but may be a controlled voltage source, a switching amplifier, a linear amplifier, a current-controlled multi-state modulation amplifier or a voltage-controlled multi-state modulation amplifier. Using a current source for controlled signal source 204 removes the effect of resistance 216 and inductance 217 on the acoustic system performance. The other input of combiner 203 receives velocity feedback 209 and acceleration feedback 210 selected to establish a desired acoustic response. The transfer function from input line 201 to the secondary winding 214 output of transformer 205 is:

$$v_s\left[\left(M'_s - K_i\left(\frac{\partial\lambda}{\partial x}\right)K_m\right)s - K_i\left(\frac{\partial\lambda}{\partial x}\right)K_\beta + \frac{1}{Z'}\right] = vK\frac{\left(\frac{\partial\lambda}{\partial x}\right)}{K_i} \tag{8}$$

where $M'_s$ is the total moving mass of the loudspeaker modeled as capacitor 206, $K_i$ is the voltage to current gain, $K_m$ is the acceleration feedback gain, $K_\beta$ is the velocity feedback gain and K is the voltage gain. For the prior art modeled in FIG. 13 with zero inductance, the transfer function from input 101 to impedance Z' 114 is :

$$v_s\left[\left(M_s s + \frac{1}{Z'}\right) + \beta\right] = vG\frac{\left(\frac{\partial\lambda}{\partial x}\right)}{R} \tag{9}$$

Given the same loudspeaker motor as in the prior art and a voltage to current gain $K_i$ for current amplifier 204 with:

$$K = \frac{G}{R}K_i \tag{10}$$

-continued $$K_\beta = -\frac{\beta}{\left(\frac{\partial\lambda}{\partial x}\right)K_i} \tag{11}$$

$$K_m = \frac{(M'_s - M_s)}{\left(\frac{\partial\lambda}{\partial x}\right)K_i}, \tag{12}$$

the transfer function equation (8) becomes exactly the same as equation (9). This relationship means that the same acoustic response achieved by the prior art system of FIG. 13 is realized by the active system according to the invention of FIG. 15. Comparing equations (9) and (8) reveals that the term from equation (8)

$$-K_i\left(\frac{\partial\lambda}{\partial x}\right)K_\beta \tag{13}$$

is equivalent to $\beta$ in equation (9) as to the effect on the system acoustic response The real efficiency of the active system, however, is still $$\beta_{real} = \frac{\left(\frac{\partial\lambda}{\partial x}\right)^2}{R} \tag{14}$$

which can be made very large by reducing the electrical resistance R without affecting the desired response. This result means that equation (13) is the effective system $\beta$ of the active system according to the invention:

$$\beta_{effective} = -K_i\left(\frac{\partial\lambda}{\partial x}\right)K_\beta. \tag{15}$$

A similar condition holds for the moving mass 206 of mass $M'_s$ of the loudspeaker motor in the active system. This results in $$M_{s\ effective} = M'_s - K_i\left(\frac{\partial\lambda}{\partial x}\right)K_m \tag{16}$$

as the effective system moving mass while the real moving mass is:

$$M_{s\ real} = M'_s \tag{17}$$

Figure 16:
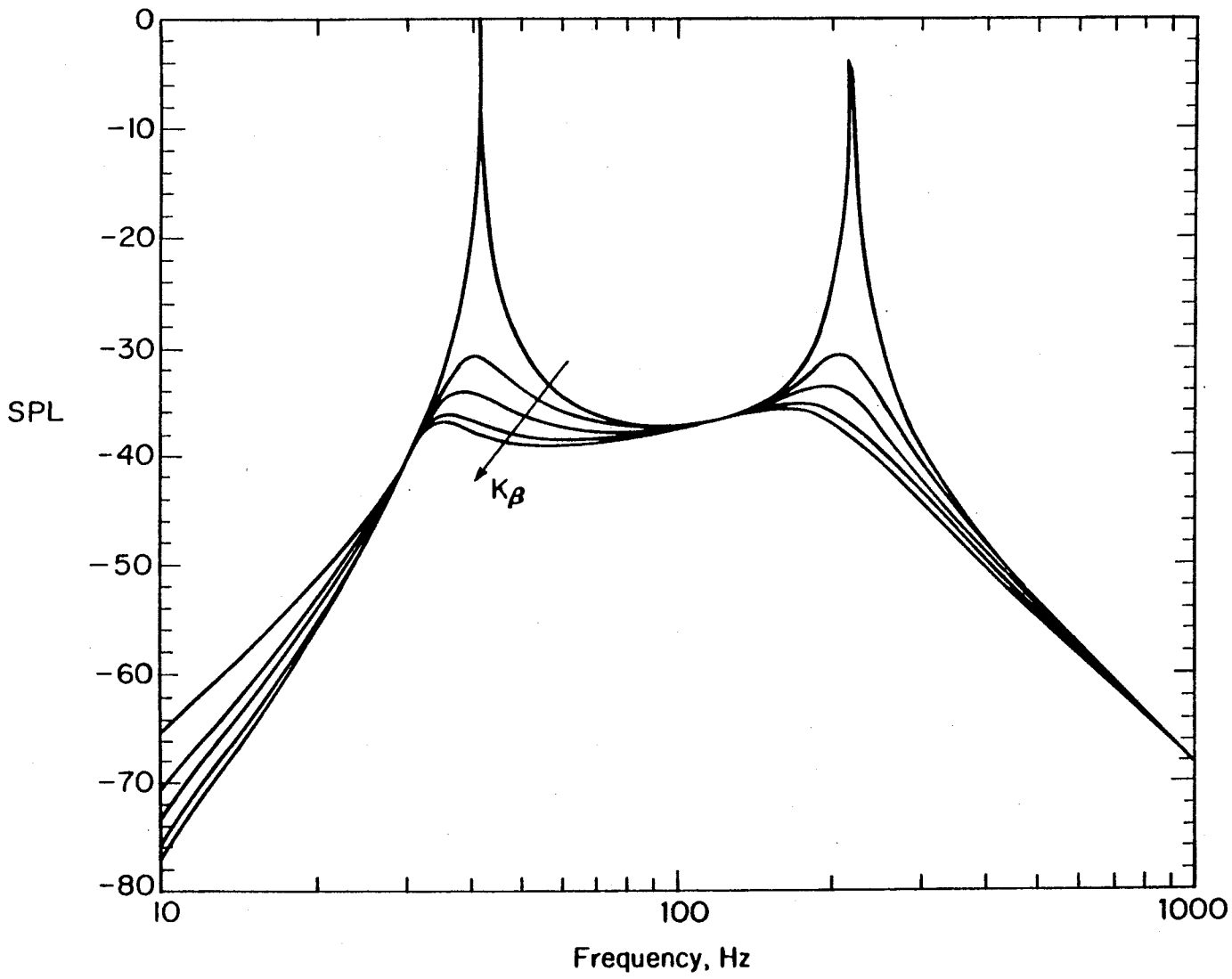
FIG. 16 is a graphical representation of frequency responses available from the system of FIG. 15 showing the effect of varying $K_\beta$.

Each of these parameters $\beta_{effective}$ and $M_{s\ effective}$ may be independently synthesized by the appropriate selections of $K_\beta$ and $K_m$. Referring to FIG. 16, there is shown a graphical representation of frequency response for illustrating the effect of $K_\beta$ on the system acoustic response. If $K_\beta$ is small, the response has sharp peaks. As $K_\beta$ is increased, the response approaches the desired flat response. An unobvious aspect of the invention is that while $\beta_{effective}$ (apparent efficiency) is determined by $K_\beta$, the real $\beta$ (true loudspeaker motor efficiency) does not change and may be made to be very high by keeping the electrical resistance R low. If the electrical resistance R is low, then thermal losses are also low; hence, the active system according to the invention may be made considerably more efficient in converting electrical energy into acoustic energy while still providing a desired smooth frequency response in the selected bandwidth.

Figure 17:
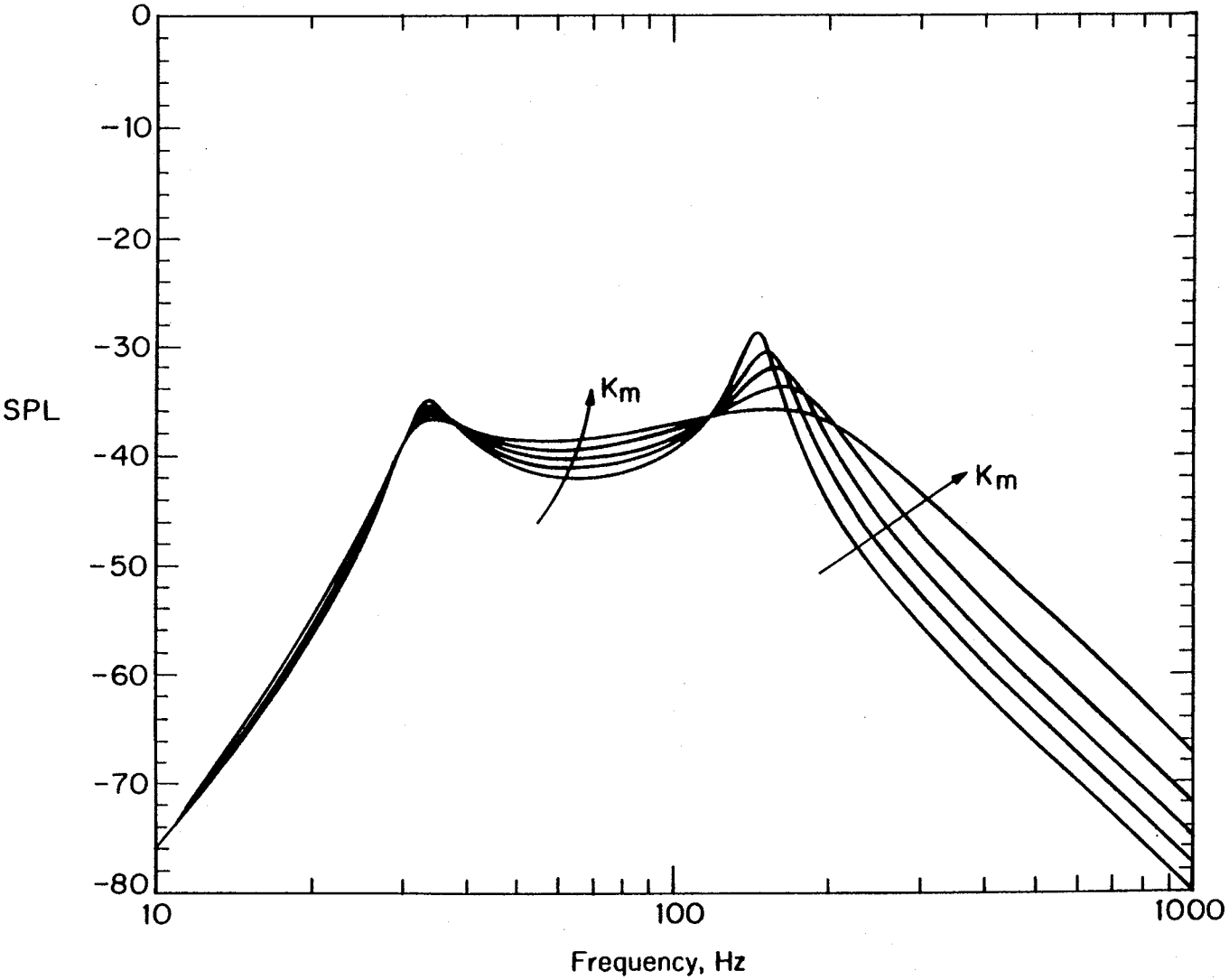
FIG. 17 is a graphical representation of frequency responses showing the effect of changing the parameter $K_m$.

Referring to FIG. 17, there is shown a graphical representation of frequency responses illustrating the effect $K_m$ has on the acoustic response for a loudspeaker motor with a large real moving mass. As $K_m$ increases the system behaves as if it has an effective moving mass that is smaller and therefore capable of achieving a higher upper half-power frequency to produce an extended frequency range at the upper end of the band. For reasons of stability it is preferred that the effective moving mass always remain positive.

Figure 18:
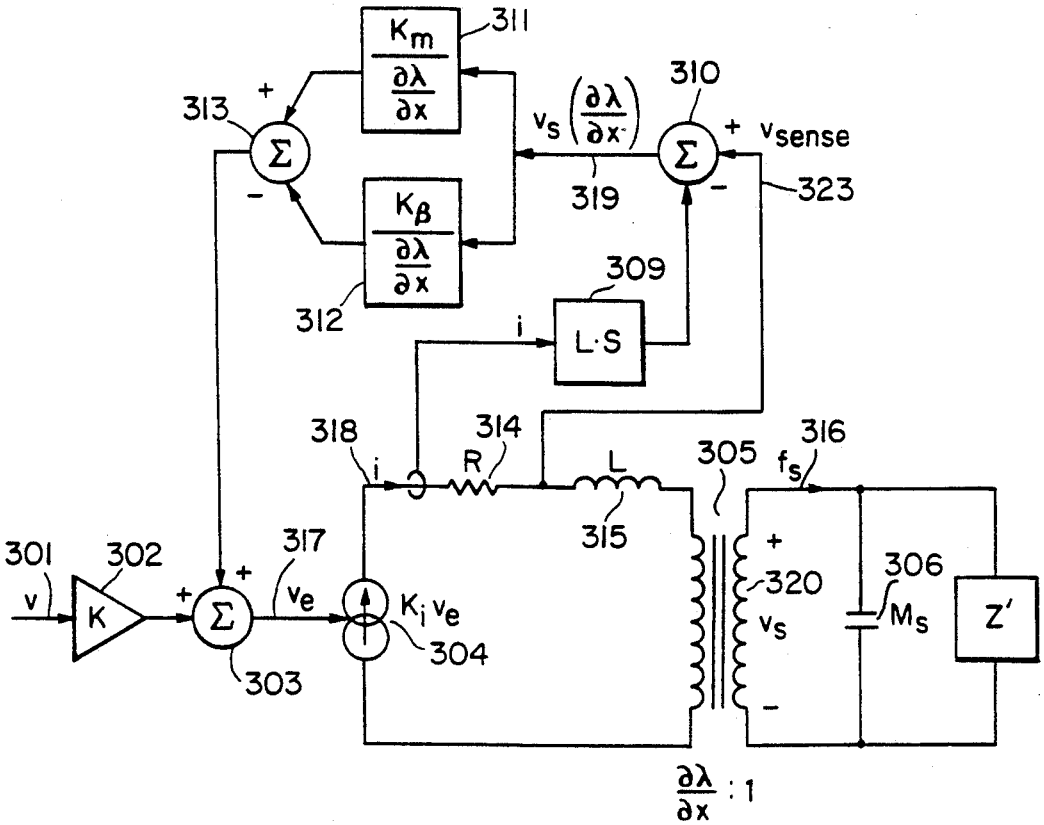
FIG. 18 is a combined block-schematic circuit diagram of another system according to the invention.

Referring to FIG. 18, there is shown another embodiment of an active system according to the invention to produce $\beta_{effective}$ and $M_{s\ effective}$ that extracts a signal proportional to the velocity $v_s$ across secondary 320 from the back voltage measured with a sense coil 323 on the motor core. Sense coil 323 measures the change in the flux in the motor core, which is a function of inductive energy stored in inductor 315 and motor velocity $v_s$ across secondary 320. The component of the sensed voltage on line 323 that is dependent on the voltage across inductance 315 is removed by subtracting a signal that is proportional to the time derivative of the current through inductor 315 provided by differentiator 309. The velocity $v_s$ across secondary winding 320 of the loudspeaker motor is thus available at the output of combiner 310 on line 319 scaled by the force coefficient $\partial\lambda/\partial x$ corresponding to the turns ratio of transformer 305. Networks 312 and 311 are selected for synthesis of effective $\beta$ and effective moving mass, respectively, taking into consideration the force coefficient $\partial\lambda/\partial x$ to provide outputs combined by combiner 313 that energizes an input of adder 303. The transfer function from input 301 through a path including combiner 303, line 317 and current source 304 to the output across secondary 320 for this system is exactly the same as equation (8).

The embodiments of FIGS. 15 and 18 assume voltage-controlled current sources 204 and 304, respectively. It is advantageous to use a current-controlled switching power amplifier to implement the voltage-controlled current source to negate the effect of the inductive component for the loudspeaker motor. The switching power amplifier may switch between two voltage states with one state more positive than the desired average output voltage and a second state more negative than the desired average output voltage. Another approach is to provide three voltage states: two states as described above and a third state approximately equal to zero. Such an approach is described in U.S. Pat. No. 4,020,361. Both the two-state and three-state approaches are very efficient in the conversion of electrical energy into useful output. If the electrical resistance 216 and 314 are kept small, $\beta_{real}$ is large, and the use of a switching amplifier results in an exceptionally efficient system for the reproduction of sound. This combination of loudspeaker driver and electrical driving system with active feedback results in an acoustic system producing the desired frequency response while remaining very efficient.

Figure 19:
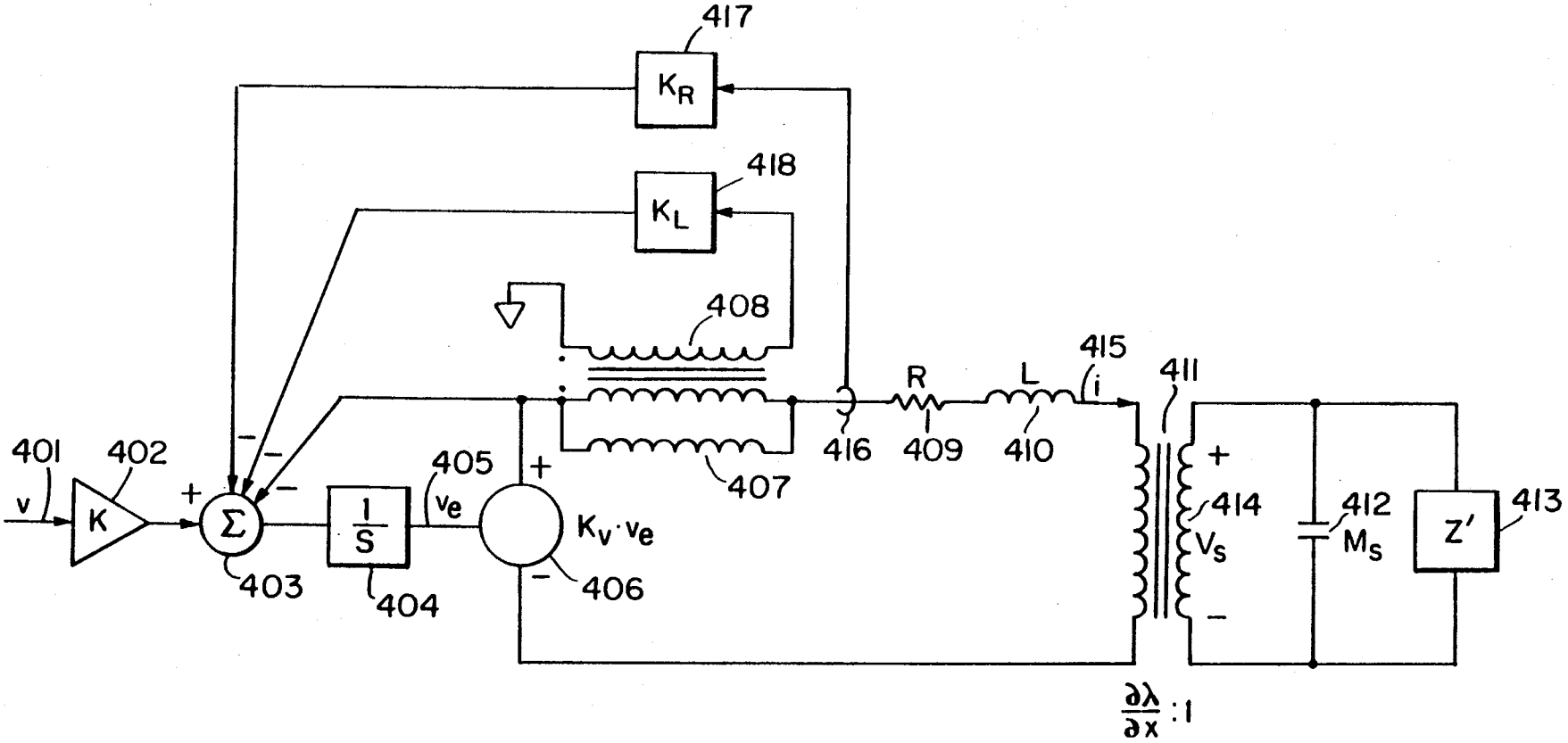
FIG. 19 is a combined block-schematic circuit diagram of still another system according to the invention.

Referring to FIG. 19, there is shown another embodiment of the invention using a voltage-controlled voltage source. In this embodiment the effect of inductance 410 of the loudspeaker motor on the response of the acoustic system is removed by feeding back a signal proportional to the derivative of motor current through differentiator network 407, 408, 418 of gain $K_L$. The electrical resistance 409 is kept small so as to reduce the thermal losses in the loudspeaker motor. By adding feedback network 417 energized by current sensor 416 with gain $K_R$, the effect of the reduction of resistance 409 on acoustic response is countered. The transfer function between the input on line 401 through a path including amplifier 402, combiner 403 that also receives feedback signals from networks 417 and 418, line 415 and transformer 411 to the output across secondary 414 in parallel with capacitance 412 modeling moving mass $M_s$ and the enclosure impedance Z'413 assuming $K_v$ is large is:

$$v_s\left(\frac{\partial\lambda}{\partial x}\right)(1 + Z'M_s s)\frac{1}{Z'}\left[\frac{1}{\left(\frac{\partial\lambda}{\partial x}\right)^2}(L - K_L L_s)s + \frac{(K_R + R)}{\left(\frac{\partial\lambda}{\partial x}\right)^2} + \frac{Z'}{(1 + Z'M_s s)}\right] = vK \tag{18}$$

The term from equation (18)

$$\frac{1}{\left(\frac{\partial\lambda}{\partial x}\right)^2}(L - K_L L_s) \tag{19}$$

is the effective inductance of the acoustic system. This property enables synthesizing the effective inductance by the appropriate choice of the gain $K_L$ for differentiator network 407, 408, 418. The other feedback term from equation (18):

$$\frac{(K_R + R)}{\left(\frac{\partial\lambda}{\partial x}\right)^2} \tag{20}$$

is the inverse of the effective $\beta$ for the system. For low values of electrical resistance R, and resultant low thermal loss, adjusting the value of $K_R$ for feedback network 417 allows establishing a desired frequency response for the acoustic system. This result is equivalent to synthesizing an effective $\beta$ while maintaining a real $\beta$ that is large. This arrangement allows the use of a high inductance and high $\beta$ loudspeaker motor while maintaining a desired system frequency response comprises equalizer circuitry coacting with the loudspeaker motor transducer for reducing nonuniformity in frequency response of the transducer within the operating frequency range thereof. A switching amplifier may also be used in this system. The amplifier preferably has an output impedance characterized by at least one of positive resistance and negative inductance, with the positive resistance being at least 1/5 the resistance of the coil to which the amplifier is connected, and the negative inductance magnitude is at least ½ the inductance of that coil.

Voltage-controlled voltage source 406 and integrator 404 model the system behavior of a voltage-controlled switching amplifier. The voltage may be applied as a three-state or two-state switching amplifier as described above. The switching amplifier may be very efficient in the conversion of electrical energy so that combined with a high $\beta$ loudspeaker motor and feedback system according to the invention, the overall sound reproduction system is exceptionally efficient.

Figure 20:
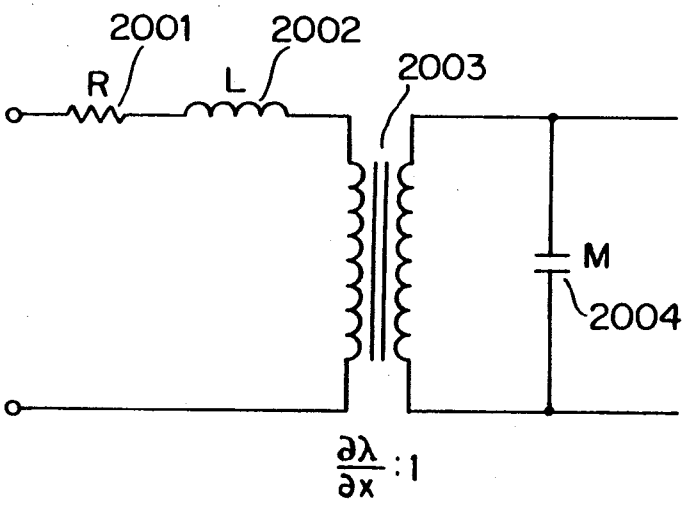
FIG. 20 is a schematic representation of a simplified electromechanical model of a transducer according to the invention.

Referring to FIG. 20, there is shown a schematic representation of a simplified electromechanical model of a transducer according to the invention. Element R 2001 represents the electrical resistance of coils 12 and 13, L 2002 the inductance of coils 12 and 13, $(\partial\lambda/\lambda x)$ 2003 the electromechanical coupling and M 2004 the moving mass of the transducer. This model is helpful in determining the bandwidth of the transducer.

The characteristic equation of this model is:

$$s^2 + \frac{R}{L}s + \frac{1}{LM\left(\frac{\partial\lambda}{\partial x}\right)^{-2}} = 0 \tag{21}$$

and solving this quadratic equation yields the critical values (poles) of the electromechanical system.

$$s_1 = -\frac{1}{2}\frac{R}{L} + \frac{1}{2}\sqrt{\frac{R^2}{L^2} - \frac{4}{LM\left(\frac{\partial\lambda}{\partial x}\right)^{-2}}} \tag{22}$$

$$s_2 = -\frac{1}{2}\frac{R}{L} - \frac{1}{2}\sqrt{\frac{R^2}{L^2} - \frac{4}{LM\left(\frac{\partial\lambda}{\partial x}\right)^{-2}}} \tag{23}$$

It is convenient to define the frequency bandwidth as the geometric mean of $s_1$ and $s_2$.

$$B.W. = \sqrt{s_1 s_2} = \sqrt{\frac{1}{LM\left(\frac{\partial\lambda}{\partial x}\right)^{-2}}} \tag{24}$$

The equation defines the upper limit for the frequency bandwidth of the transducer under ideal conditions.

Figure 21:
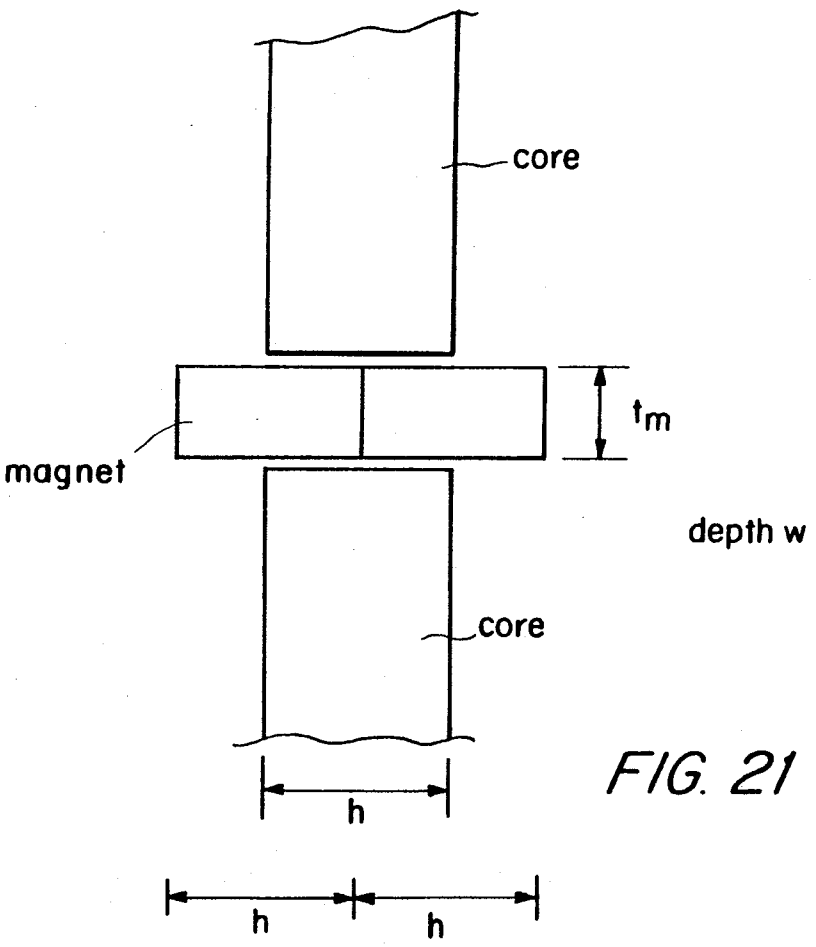
FIG. 21 shows a transducer according to the invention helpful in analysis.

Referring to FIG. 21, there is shown a transducer helpful in determining minimum inductance $L_{min}$ and mass $M_{min}$ under ideal conditions.

$$L_{min} = \frac{N^2\omega h\mu_m}{t_m} \tag{25}$$

$$M_{min} = 2hwt_m d_m \tag{26}$$

where

N is number of turns $\omega$ is angular frequency, radians/second h is height of magnet, meters $\mu_m$ is Linear permeability of magnet material, Henries/meter $t_m$ is thickness of magnet, meters and $d_m$ is density of magnet material, Kg/m$^3$ The maximum $(\partial\lambda/\partial x)$ is:

$$\left(\frac{\partial\lambda}{\partial x}\right) = \frac{2B_0 whN}{h} \tag{27}$$

under ideal conditions. Substituting these parameters in equation 24 yields the maximum frequency bandwidth (radians per second), $B.W._{max}$, for the transducer of FIG. 21 under ideal conditions:

$$B.W._{max} = \frac{B_o}{h}\sqrt{\frac{2}{d_m\mu_m}} \tag{28}$$

A speaker transducer produces a maximum volume displacement $V_{max}$, over a desired bandwidth for a given maximum sound pressure level (loudness) This maximum volume displacement is expressed as the peak-to-peak excursion of the motor times the effective area of the speaker diaphragm. For the transducer according to the invention:

$$V_{max} = hA_s \tag{29}$$

where $A_s$ is the effective area of the speaker diaphragm. Since for a given speaker and enclosure combination the maximum volume displace $V_{max}$ is constant, equation 28 can be expressed to account for this constraint.

$$B.W._{max} = \frac{B_o A_s}{V_{max}}\sqrt{\frac{2}{d_m\mu_m}} \tag{30}$$

This equation reveals that if the speaker transducer is expected to produce a fixed $V_{max}$, then increasing the cone area increases the bandwidth. This property is also true of prior art moving coil speaker motors, however, for a moving coil speaker to take advantage of this result the magnet structure would be prohibitively large for high sound pressure level (SPL) bass reproduction. The speaker transducer according to the invention, on the other hand, can take advantage of this result while being practical to realize.

Other embodiments are within the claims.

What is claimed is:

1. A transducer comprising, a core of low reluctance magnetic material formed with an air gap separating opposed pole faces of said core, at least one coil wound on said core adjacent to and substantially contiguous with said air gap, and a permanent magnet assembly in and substantially filling said air gap in noncontacting relationship with said core and supported to allow relative movement between said permanent magnet assembly and said core.

2. A transducer in accordance with claim 1 wherein said core is generally C-shaped.

3. A transducer in accordance with claim 1 wherein said core is substantially 8-shaped.

4. A transducer in accordance with claim 1 wherein said core is substantially U-shaped.

5. A transducer in accordance with claim and further comprising a frame having first and second ends, a first suspension element at said second end, a second suspension element, said permanent magnet assembly being connected between said first and second suspension elements.

6. A transducer in accordance with claim 5 wherein said first and second suspension elements and said permanent magnet assembly are mounted to said frame.

7. A transducer in accordance with claim 1 wherein said permanent magnet comprises first and second contiguous permanent magnet elements having adjacent unlike poles along a boundary substantially midway between opposed surfaces of said core along the direction of said relative movement.

8. A transducer in accordance with claim 1 and further comprising a loudspeaker diaphragm connected to said permanent magnet assembly.

9. A transducer is accordance with claim 5 and further comprising, a loudspeaker diaphragm connected to said permanent magnet, said first and second suspension elements being spiders.

10. A transducer in accordance with claim 1 and further comprising, a combiner having a signal input, a feedback input and an output for providing a combined signal on the combiner output related to the combination of the signals on said signal input and said feedback input, a controlled signal source having an input coupled to said combiner output and a signal output providing a controlled signal related to the signal on the controlled signal source input, said controlled signal source output being connected to said at least one coil, and a feedback circuit intercoupling said transducer and said combiner feedback input.

11. The apparatus of claim 10 wherein said feedback circuit provides a feedback signal related to at least one of velocity and acceleration of said permanent magnet assembly.

12. The apparatus of claim 11 wherein said feedback circuit comprises, a source of a velocity signal related to said velocity, a differentiator for providing a derivative signal proportional to the time derivative of the signal provided by said controlled signal source, an input combiner having a derivative input for receiving said derivative signal and a velocity input for receiving said velocity signal and an output for providing a scaled velocity signal related to the combination of signals on said velocity and derivative inputs, an effective Beta network having an input coupled to said input combiner output and an output for providing an effective Beta signal, an effective moving mass network having an input coupled to said input combiner output and an output for providing an effective moving mass signal, and an output combiner having an effective Beta input coupled to the effective Beta network output, an effective moving mass input coupled to the effective moving mass network output and an output for providing a signal related to the signals on said effective Beta input and said effective moving mass input and coupled to said combiner feedback input.

13. The apparatus of claim 10 wherein said controlled signal source is a controlled voltage source.

14. The apparatus of claim 10 wherein said controlled signal source is a controlled current source.

15. The apparatus of claim 10 wherein said controlled signal source is a switching amplifier.

16. The apparatus of claim 10 wherein said controlled signal source is a linear amplifier.

17. The apparatus of claim 15 wherein said controlled signal source is a current-controlled multi-state modulation amplifier.

18. The apparatus of claim 15 wherein said controlled source is a voltage-controlled multi-state modulation amplifier.

19. A transducer in accordance with claim 1 wherein there are first and second coils wound on said core adjacent to, substantially contiguous with and on opposite sides of said gap.

20. The apparatus of claim 16 and further comprising, equalizer circuitry coacting with said transducer for reducing nonuniformity in frequency response of said transducer within the operating frequency range thereof.

21. The apparatus of claim 13 wherein said feedback circuit comprises, a differentiator network intercoupling said transducer and said combiner arranged to provide a feedback signal proportional to the current in said at least one coil, and a resistance sensitive network intercoupling said transducer and said combiner arranged to provide a feedback signal that reduces the effect of the resistance of said at least one coil.

22. The transducer of claim 1 wherein the operating frequency range of said transducer is in the bass frequency range with a bandwidth of the order of $\sqrt{(1/LM(\partial\lambda/\lambda x)^{-2})}$, where L is the coil inductance, M is the transducer moving mass and $\partial\lambda/\lambda x$ is the electromechanical coupling between coil inductance and moving mass.

23. A transducer in accordance with claim 8 and further comprising, first and second suspension elements respectively connected to opposite ends of said permanent magnet assembly, the combined mass of said loudspeaker diaphragm and said suspension elements being less than twice the mass of said permanent magnet assembly, said transducer having coil inductance with at least one-third of said coil inductance being attributable to magnetic energy stored in said gap.

24. A transducer in accordance with claim 8 wherein the mass of said permanent magnet assembly is at least 10 grams.

25. A transducer in accordance with claim 24 wherein the area of said diaphragm is greater than or equal to 0.015 $m^2$.

26. A transducer in accordance with claim 1 and further comprising, an amplifier connected to said at least one coil, said amplifier having an output impedance characterized by at least one of positive resistance and negative inductance, said positive resistance being at least 1/5 the resistance of said at least one coil.

27. Apparatus in accordance with claim 26 wherein said amplifier is a switching amplifier.

28. Apparatus in accordance with claim 26 wherein said negative inductance magnitude is at least ½ the inductance of said at least one coil.

29. A transducer in accordance with claim 1 wherein said core is symmetrical about a first plane generally perpendicular to a second plane about which said permanent magnet assembly is symmetrical with the path of relative movement being in said second plane between first and second end points on opposite sides of said first plane and extension of said path beyond said end points being free of intersection with said core.

30. A transducer in accordance with claim 29 wherein said cores is generally C-shaped.

31. A transducer in accordance with claim 29 wherein said core is substantially 8-shaped.

32. A transducer in accordance with claim 29 wherein said core is substantially U-shaped.

33. A transducer in accordance with claim 29 and further comprising a frame having first and second ends, a first suspension element at said second end, a second suspension element, said permanent magnet assembly being connected between said first and second suspension elements.

34. A transducer in accordance with claim 33 wherein said first and second suspension elements and said permanent magnet assembly are mounted to said frame.

35. A transducer in accordance with claim 29 wherein said permanent magnet comprises first and second contiguous permanent magnet elements having adjacent unlike poles along a boundary substantially in said first plane when substantially midway between said end points.

36. A transducer in accordance with claim 29 and further comprising a loudspeaker diaphragm connected to said permanent magnet assembly.

37. A transducer is accordance with claim 33 and further comprising, a loudspeaker diaphragm connected to said permanent magnet assembly, said first and second suspension element being spiders.

38. A transducer in accordance with claim 29 and further comprising, a combiner having a signal input, a feedback input and an output for providing a combined signal on the combiner output related to the combination of the signals on said signal input and said feedback input, a controlled signal source having an input coupled to said combiner output and a signal output providing a controlled signal related to the signal on the controlled signal source input, said controlled signal source output being connected to said at least one coil, and a feedback circuit intercoupling said transducer and said combiner feedback input.

39. The apparatus of claim 38 wherein said feedback circuit provides a feedback signal related to at least one of velocity and acceleration of said permanent magnet assembly.

40. The apparatus of claim 39 wherein said feedback circuit comprises, a source of a velocity signal related to said velocity, a differentiator for providing a derivative signal proportional to the time derivative of the signal provided by said controlled signal source, an input combiner having a derivative input for receiving said derivative signal and a velocity input for receiving said velocity signal and an output for providing a scaled velocity signal related to the combination of signals on sad velocity and derivative inputs, an effective Beta network having an input coupled to said input combiner output and an output for providing an effective Beta signal, an effective moving mass network having an input coupled to said input combiner output and an output for providing an effective moving mass signal, and an output combiner having an effective Beta input coupled to the effective Beta network output, an effective moving mass input coupled to the effective moving mass network output and an output for providing a signal related to the signals on said effective Beta input and said effective moving mass input and coupled to said combiner feedback input.

41. The apparatus of claim 38 wherein said controlled signal source is a controlled voltage source.

42. The apparatus of claim 38 wherein said controlled signal source is a controlled current source.

43. The apparatus of claim 38 wherein said controlled signal source is a switching amplifier.

44. The apparatus of claim 38 wherein said controlled signal source is a linear amplifier.

45. The apparatus of claim 43 wherein said controlled signal source is a current-controlled multi-state modulation amplifier.

46. The apparatus of claim 43 wherein said controlled source is a voltage-controlled multi-state modulation amplifier.

47. A transducer in accordance with claim 29 wherein there are first and second coils wound on said core adjacent to, substantially contiguous with and one opposite sides of said gap.

48. The apparatus of claim 44 and further comprising, equalizer circuitry coacting with said transducer for reducing nonuniformity in frequency response of said transducer within the operating frequency range thereof.

49. The apparatus of claim 41 wherein said feedback circuit comprises, a differentiator network intercoupling said transducer and said combiner arranged to provide a feedback signal proportional to the current in said at least one coil, and a resistance sensitive network intercoupling said transducer and said combiner arranged to provide a feedback signal that reduces the effect of the resistance of said at least one coil.

50. The transducer of claim 29 wherein the operating frequency range of said transducer is in the bass frequency range with a bandwidth of the order of $\sqrt{(1/LM(\partial\lambda/\lambda x)^{-2})}$, where L is the coil inductance, M is the transducer moving mass and $\partial\lambda/\lambda x$ is the electromechanical coupling between coil inductance and moving mass.

51. A transducer in accordance with claim 36 and further comprising, first and second suspension elements respectively connected to opposite ends of said permanent magnet assembly, the combined mass of said loudspeaker diaphragm and said suspension elements being less than twice the mass of said permanent magnet assembly, said transducer having coil inductance with at least one-third of said coil inductance being attributable to magnetic energy stored in said gap.

52. A transducer in accordance with claim 36 wherein the mass of said permanent magnet assembly is at least 10 grams.

53. A transducer in accordance with claim 52 wherein the area of said diaphragm is greater than or equal to 0.015 $m^2$.

54. A transducer in accordance with claim 29 and further comprising, an amplifier connected to said at least one coil, said amplifier having an output impedance characterized by at least one of positive resistance and negative inductance, said positive resistance being at least 1/5 the resistance of said at least one coil.

55. Apparatus in accordance with claim 54 wherein said amplifier is a switching amplifier.

56. Apparatus in accordance with claim 54 wherein aid negative inductance magnitude is at least ½ the inductance of said at least one coil.

* * * * *

UNITED STATES PATENT AND TRADEMARK OFFICE

CERTIFICATE OF CORRECTION

PATENT NO. : 5,216,723

DATED : June 1, 1993

INVENTOR(S) : Thomas A. Froeschle et al.

It is certified that error appears in the above-identified patent and that said Letters Patent is hereby corrected as shown below:

Column 4, line 1, "18" should read --15--.

Column 6, line 8, before "on" should appear --P-- and "11" should read --110--.

Column 6, line 10, after "114." should be --$Z' = Z/A_s^2$--.

Column 12, line 57, after "claim" should be --1--.

Column 15, line 63, "sad" should be --said--.

Column 16, line 26, "one" should be --on--.

Signed and Sealed this

Fourteenth Day of June, 1994

Bruce Lehman

BRUCE LEHMAN

*Commissioner of Patents and Trademarks*

*Attest:*

*Attesting Officer*